United States Patent [19]

Kuehnle et al.

[11] 4,262,998

[45] Apr. 21, 1981

[54] ELECTROPHOTOGRAPHIC ATTACHMENT FOR USE WITH AN OPTICAL PROJECTING SYSTEM

[75] Inventors: Manfred R. Kuehnle, Lexington; George J. Perry, Sudbury, both of Mass.

[73] Assignee: Coulter Systems Corporation, Beford, Mass.

[21] Appl. No.: 964,207

[22] Filed: Nov. 28, 1978

Related U.S. Application Data

[63] Continuation-in-part of Ser. No. 802,573, Jun. 1, 1977, abandoned.

[51] Int. Cl.[3] ..... G03G 15/10

[52] U.S. Cl. ..... 355/10; 118/661; 355/77; 430/117

[58] Field of Search ..... 355/10, 16, 3 R, 77; 354/3, 317, 325; 96/1 R; 427/15, 30; 430/117–119; 118/651, 661

[56] References Cited

U.S. PATENT DOCUMENTS

| | | | |
|---|---|---|---|
| 3,284,224 | 11/1966 | Lehmann | 355/10 X |
| 3,299,787 | 1/1967 | Kolb et al. | 355/10 |
| 3,372,630 | 3/1968 | Schmidt | 354/324 |
| 3,773,416 | 11/1973 | Kushima | 355/3 TE |
| 4,003,651 | 1/1977 | Hashida et al. | 355/15 X |

*Primary Examiner*—Richard L. Moses

*Attorney, Agent, or Firm*—Silverman, Cass & Singer, Ltd.

[57] ABSTRACT

An electrophotographic attachment for use with an optical projecting system for making a copy of a document on a sheet of carrier material.

The attachment includes an electrophotographic belt that is mounted on rollers. The belt is rotated through a charging station, an exposure station, a toning station, an image transfer station and a cleaning station. The toning station includes a toning platen which serves to assist in the application of toner from a supply to the belt. Four embodiments of the toning station are described.

33 Claims, 9 Drawing Figures

ELECTROPHOTOGRAPHIC ATTACHMENT FOR USE WITH AN OPTICAL PROJECTING SYSTEM

REFERENCE TO RELATED APPLICATION:

This application is a Continuation-In-Part of Application Ser. No. 802,573 filed June 1, 1977, now abondoned.

BACKGROUND OF THE INVENTION

This invention relates to electrophotography. It is now well known in the art to make a copy of a document by forming a latent electrostatic image of the document on an electrophotographic member, toning the latent image to make it visible and then transferring the toned image to a sheet of carrier material such as paper.

The invention herein revolves around a type of electrophotographic film that is capable of being imaged with quality and gray scale as good as, if not better than, that achieved by photographic film and with resolution that is better than that achieved by photographic film. The film includes an inorganic coating of microcrystalline material that is bonded onto a conductive substrate. In a preferred embodiment the inorganic coating comprises a layer of radio frequency sputtered cadmium sulfide that is from about 2,000 Angstroms to about 2 microns thick and the conductive substrate comprises a layer of about 300 to 500 Angstroms thick of indium tin oxide which in turn is disposed on a sheet of stable polyester plastic about 5 mils thick. The film is described in U.S. Pat. No. 4,025,339 issued May 24, 1977.

SUMMARY OF THE INVENTION

An electrophotographic attachment for use with an optical projecting system for making a copy of a document on a sheet of carrier material.

The attachment includes an electrophotographic belt that is mounted on rollers. The belt is rotated through a charging station, an exposure station, a toning station, as image transfer station and a cleaning station. The toning station includes a toning platen which serves to assist in the application of toner from a supply to the belt. Four embodiments of the toning station are described.

DESCRIPTION OF THE PREFERRED EMBODIMENTS

As used throughout the specification and claims the term "electrophotographic belt" is intended to mean an endless, flexible belt of which at least a portion of its length is an electrophotographic film, that is, is either made of or contains a photoconductive coating on a conductive substrate that can be used for electrophotographic purposes.

Copies of documents are made electrophotographically by a technique which requires that an image be formed of the document to be reproduced. The image is formed using an optical projecting system.

Figure 1:
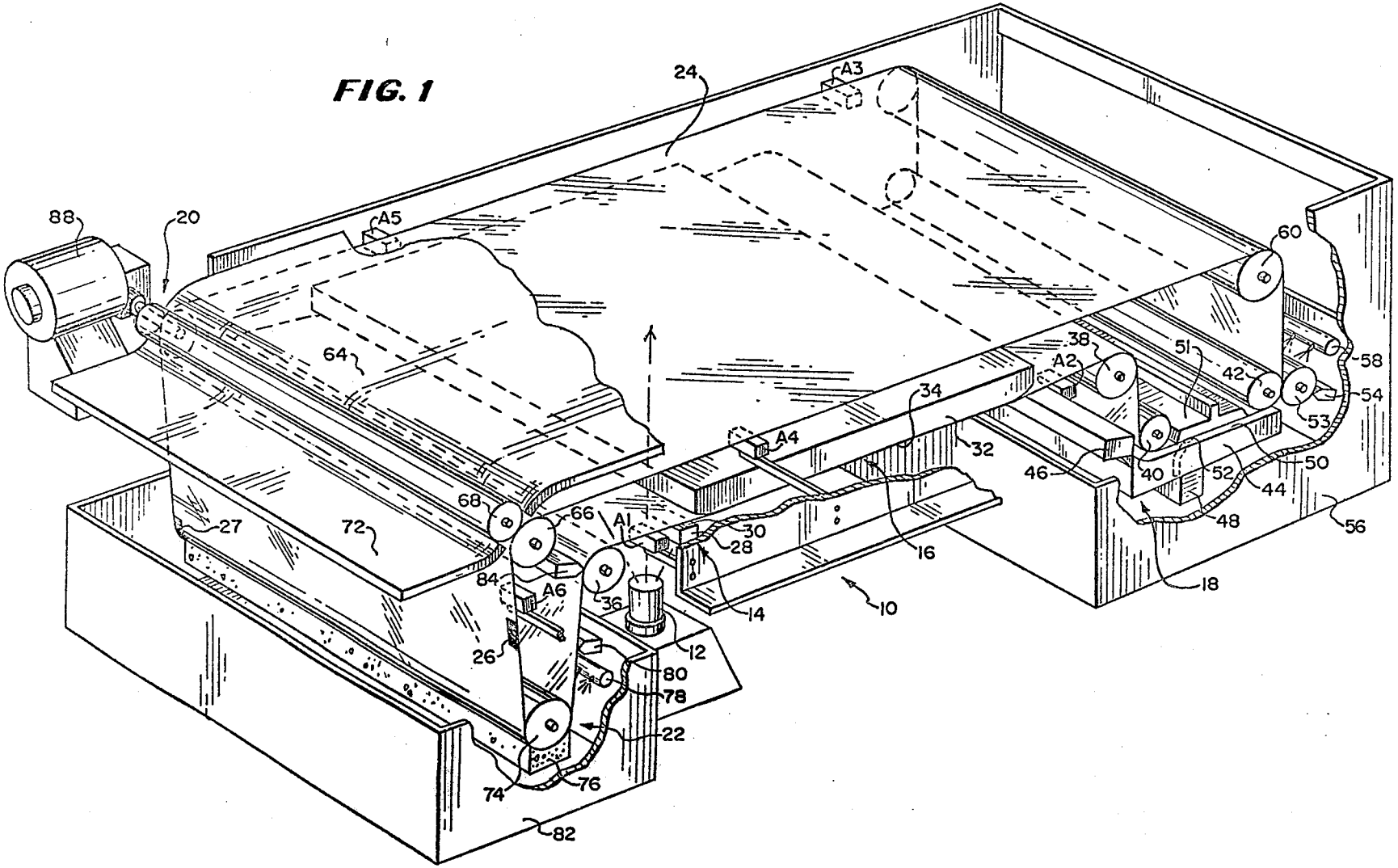
FIG. 1 is a perspective partially sectional view of one embodiment of the attachment of the invention.
Figure 2:
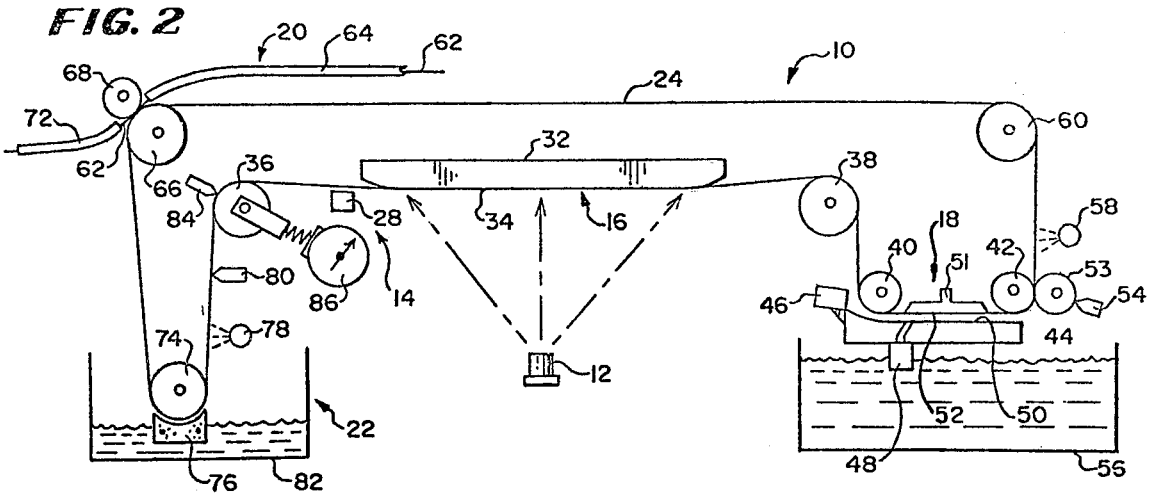
FIG. 2 is a diagram of the attachment of FIG. 1 showing the basic parts and construction thereof.

FIGS. 1 and 2 illustrate one embodiment of the attachment 10 of the invention. The attachment 10 is positioned to receive an image of a document from an optical projecting system shown diagrammatically by a lens 12. The attachment 10 is shown totally exposed; however, of course, the attachment 10 and the lens 12 are married together such that no light would enter the system except as desired through the lens 12. In this respect a cover is fastened over the attachment 10 which is not illustrated.

The attachment 10 includes a sequence of stations including a charging station 14, an exposure station 16, a toning station 18, a transfer station 20 and a cleaning station 22. An endless web 24 mounted on rollers is rotated through the stations and the web includes a portion of electrophotographic film upon which the image may be projected and transferred from. The web 24 need only contain a portion of electrophotographic film large enough to cover the area to be imaged in the exposure station 16; however, the web 24 may be made entirely from the electrophotographic film. One electrophotographic film which may be utilized in the invention as previously mentioned is described in U.S. Pat. No. 4,025,339 issued May 24, 1977.

In operation a starting point on the web 24 is chosen, prior to the film portion to be acted upon, such as a point on the periphery of the web 24 which may be a piece of metallic material or strip 26. The strip 26 may then be optically or magnetically sensed as the web 24 passes to the various stations to control the operations and timing of the attachment 10. There may be a second metallic strip 27 on the opposite pheriphery of the web 24 which may be sensed by sensors on the opposite side of the attachment. The timing of the device may also be accomplished by conventional timing mechanisms such as a timing belt or counter without the use of the sensors and strips.

The overall operation of the attachment 10 will be given prior to the details of the various stations to set forth the environment of the stations. The attachment 10 is operated by starting the web 24 rotating through the various stations. When the film portion to be exposed reaches the charging station 14 it will be charged by a corona source either as it moves by the corona source or by stopping the web and moving the corona source relative to the film portion. Once the film portion is charged the web is rotated until the film portion is located in the exposure station 16 where it is stopped and exposed by the optical projection system through lens 12. The film portion is then rotated through the toning station 18 where toner is applied to the image which has been projected onto the film portion. The web 24 continues to rotate until it reaches the transfer station 20 where the toned image is transferred from the film portion onto a sheet of carrier material such as plain paper. Once the image has been transferred, the web 24 will continue its rotation through the cleaning station 22 where any remaining toner or other material will be cleaned from both sides of the web 24 and the web is then rotated completely around to the start position ready for the next imaging and transfer operation. The cleaning station 22 is optional, because the operation of the other stations of attachment 10 under the proper conditions would remove all the toner from the film portion at the transfer station 20 leaving the film portion ready to be recycled for the next imaging operation without the intervening cleaning step.

The components of the various stations and the detailed operations thereof will now be set forth. The charging station 14 includes a corona voltage source 28 which contains a corona wire or wires 30. The corona voltage source 28 may be fixed to charge the film portion as it passes over the corona source and wire 30 or it may oscillate to provide an even distribution of charge on the film portion. The film portion as utilized hereinafter is that portion of the web 24 which is chosen to be exposed in the exposure station 16. The film portion may also be stopped and the corona source 28 may be moved across the film portion to provide the even distribution of charge on the film portion. The corona source 28 will preferably be operated at a voltage of approximately 6,000 volts.

Once the film portion is charged to $8\times10^{-7}$ coulombs/cm$^2$ or 30 volts equivalent the charged film portion is moved into the exposure station 16. The exposure station 16 includes an exposure platen 32 which is disposed above the web 24 with a lower smooth planar surface 34 disposed below the untensioned plane of the web 24 between the rollers 36 and 38. The surface may be beveled at each end to facilitate the passage of the web thereover and the surface will be located in the image plane of the camera system and lens 12. Thus, the web 24 will be drawn tightly and smoothly across the bottom surface 34 so that a smooth unwrinkled surface will be presented to the camera system and lens 12. To further facilitate the passage of the web 24 past the platen 32, the platen 32 is preferably provided with a series of passageways (not shown) disposed across and opening to the bottom surface 34 which are connected to a source of positive fluid pressure (not shown). The pressure source is energized when the belt 24 is moving, but is deenergized when the belt is stopped in the exposure station 16 so that the film 24 will be drawn against the smooth platen surface 34.

Figure 8:
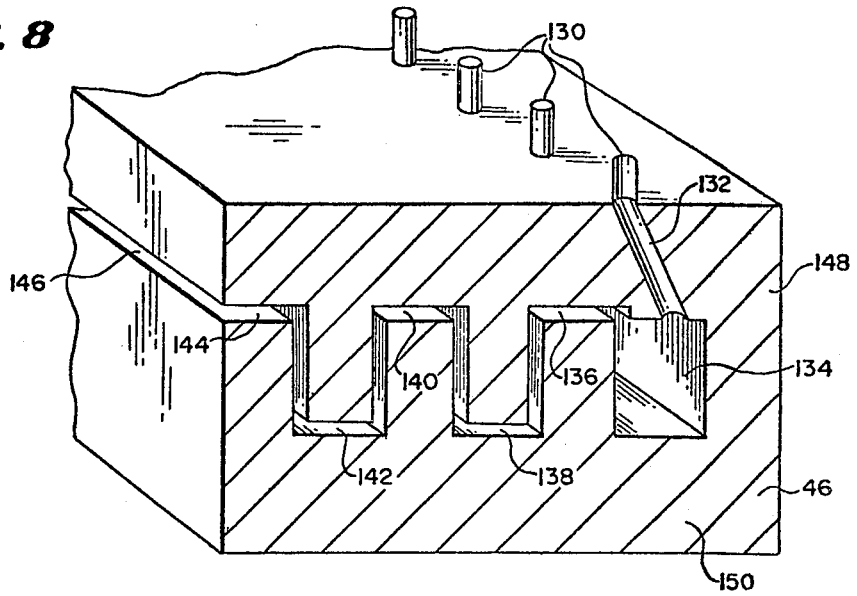
FIG. 8 is a side sectional view of a toning manifold which may be used with the attachment.

Once the film portion has been exposed it is rotated over the ohmic roller 38 and across the direction rolls 40 and 42 in the toning station 18. The web 24 is tensioned between the direction rolls 40 and 42 to form a smooth planar reach with a gap between the film portion and a toning platen 44. The toner in liquid or dry form is applied in the gap. Preferably the toner is in liquid form and is supplied through at least one of a pair of manifolds 46 and 48 (FIG. 8). Preferably the manifold 46 is used in conjunction with the manifold 48 to form a smooth nonturbulent flow of toner in the gap formed between the toning platen 44 and the film portion. A toning bias, preferably, is electrically applied between the toning platen 44 and the web 24 to assist in the toner particles adhering to an image on the film portion.

The toning platen 44 has an upper generally planar surface 50 between the rolls 40 and 42 to maintain the gap between the film portion and the toning platen. An upper shoe 51 may be utilized which has a bottom planar surface 52 disposed parallel to the surface 50. The surface 52 keeps the film portion planar between the rolls 40 and 42 to precisely maintain the gap. The toning bias may be in a range of negative 5–25 volts, preferably about 11 volts. The gap may be in the range of 5 to 40 mils, preferably about 12 mils. The upper surface 50 of the toning platen 44 is smoothly polished so that the toning particles and fluid will flow smoothly over the surface thereof and not become adhered to any particular portion thereof.

Any excess toner is removed from the film portion by an extraction roller 53 as the film portion passes by the extraction roller. The extraction roller 53 is spaced from the web 24 which space may be less than 6 mils, preferably about 4 mils, and it is electrically biased to withdraw the toner particles which are not firmly adhered to the imaged portion of the film. The bias may be in a range of negative 20–250 volts, preferably about 135 volts. The toner particles and liquid are removed from the extraction roller 53 by a squeegee 54. The toner which is not utilized and the fresh toner are captured in a tray or reservoir 56 which is located beneath the other components of the toning station 18.

To assist in the extraction of the excess toner particles from the film portion a spray bar 58 is located above the extraction roller 53 and will spray a film of toner liquid into the gap between the web 24 and the extraction roller 53 to provide a medium for the toner particles and the electric field between the extraction roller and the film to allow the excess toner particles to be removed.

The web and film portion continue rotating from the toner station 18 over a guide or direction roller 60 to the transfer station 20 where the image is transferred to a sheet or carrier material 62. Carrier material 62 is passed into a first chute 64 which directs the carrier material 62 past a tangent point of the web 24 but spaced therefrom. The web 24 passes over another roller 66 in the transfer station 20 which locates the web and the film portion as it passes through the transfer station. A freely rotatable transfer roller 68 is disposed for pivotal movement away from and in close proximity to the web 24 such as on a pivot arm 70. The sheet 62 such as a piece of paper extends between the two rollers 66 and 68, but is not in contact with the web 24. Preferably, the medium 62 will extend into a discharge chute 72 to precisely locate the sheet of carrier material 62. When the front edge of the imaged portion arrives in the transfer station 20, the transfer roller 68 is pivoted against the sheet 62 to bring it into close proximity with the web 24 to transfer the image to the sheet 62 which will rotate with the rotating belt 24 between the rollers 66 and 68. A transfer bias may be applied between the roller 68 and the web 24 and may be in the range of negative 250–1200 volts. The transfer bias should be just sufficient to fully transfer any toned image and will preferably be about negative 500 volts. The roller 68 may bring the medium 62 directly against the film portion or may leave a slight gap to avoid mechanical smearing of the image if the medium 62 will not absorb the fluid surrounding the toner particles on the film portion. The gap may be in the range of 0–4 microns.

The web 24 then moves on into the cleaning station 22 where it passes around another roller 74 and past a foam cleaning brush 76 which dislodges any firmly attached toner particles or other material which have not been removed by the transfer operation. The web 24 then passes past a cleaning spray bar 78 which sprays a cleaning fluid against the film which is squeegeed by an air brush or knife 80 which provides a smooth flow of air across the width of the film and may contain a fluid baffle such as 46 or 48. The nozzle of the air brush 80 is coated with a nonabrasive material; however, the web and film portion thereof preferably will not touch the air brush due to the flow of the air from the nozzle. The cleaning solution and excess toner particles are caught in a reservoir 82 located at the bottom of the cleaning station 22. The back or inside of the web 24 is cleaned by a squeegee 84 as it passes the adjustable ohmic guide roller 36. The ohmic roller 36 has an adjustment at each end 86, one of which is shown, to steer the web around the sets of rollers in the attachment 10 without excessive lateral movement thereof. The web 24 then continues through the other stations without their being energized and returns to the initial or stop position ready for another cycle. As previously mentioned with the proper biasing, toning and transfer conditions, cleaning station 22 may be eliminated.

Figure 3:
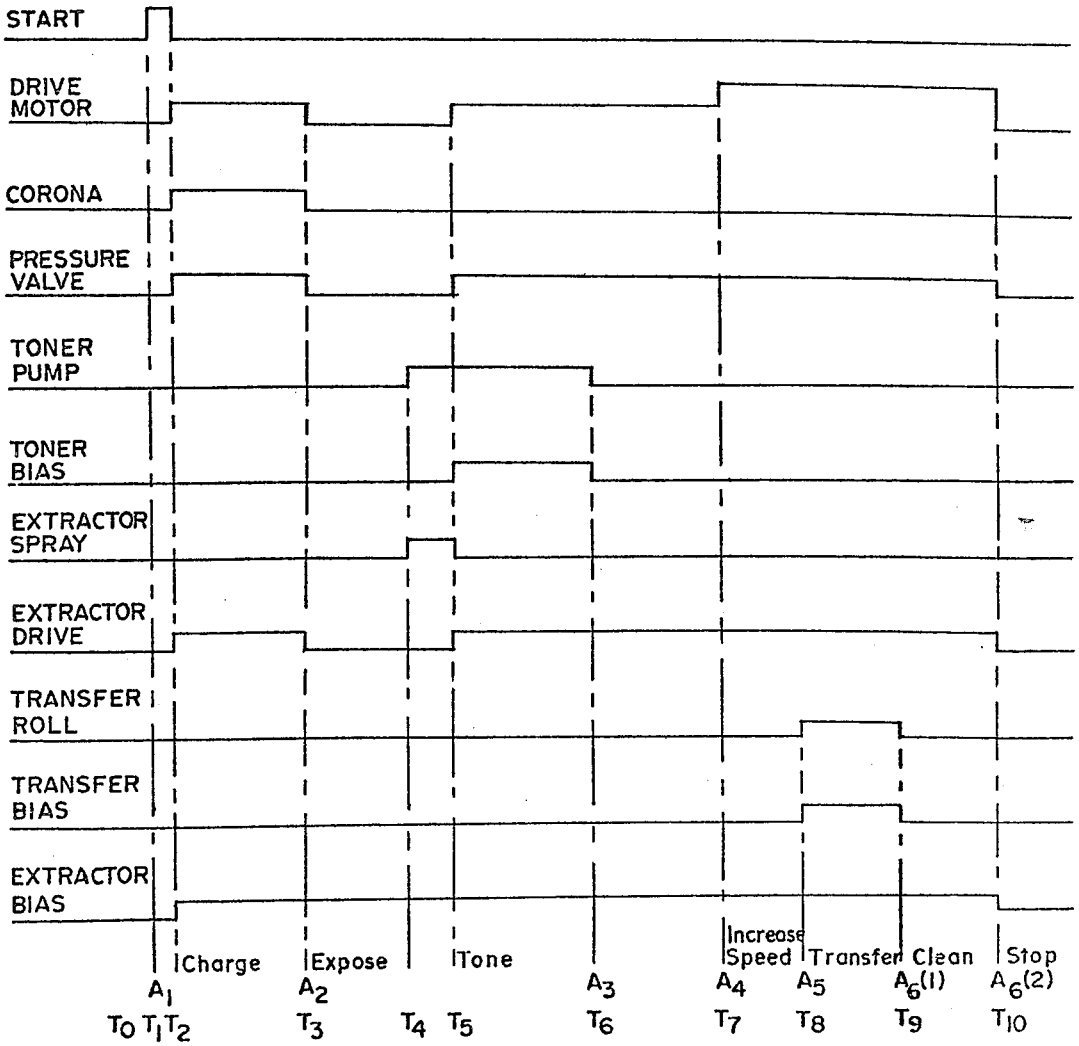
FIG. 3 is a timing diagram illustrative of the operation of the attachment.

Referring now to FIG. 3, a timing diagram for the attachment 10 is illustrated; however, it should be noted that the time factor between each of the times $T_0$ through $T_{10}$ is not drawn to scale and these will vary as determined by a particular operation, size of components, etc. The operation will be explained with the timing diagram utilizing the sensors $A_1$ through $A_6$ which sense the metallic strips 26 and 27 along the peripheries of the web 24.

At time $T_0$ the start mechanism is energized which will activate a drive motor 88 starting the web rotating, energizing the pressure valve in the exposure platen 32, rotating the extractor roll 53 and applying the bias to the extractor roll. At time $T_2$, upon sensing the strip 26 by the sensor $A_1$, the corona voltage source 28 will be energized and the charge will be applied to the film portion until time $T_3$ when the strip 26 is sensed by the sensor $A_2$. At time $T_3$ the drive motor will stop, the corona voltage source will deenergize, the pressure valve and the exposure platen 32 will deenergize, drawing the film against the platen surface 34. The extractor roll 53 will also stop rotating as it is geared to the drive motor 88; however, it could be kept rotating by a separate drive if desired. The film portion is then exposed by the camera through the lens 12 by opening a shutter within the camera to project a light image onto the film.

At time $T_4$, prior to the end of the exposure and the restart of the rotation of the web 24, the toner pump (not shown) will be operated to flow toner through the manifolds 46 and 48 and the extractor spray will be operated to fill the gap between the extraction roll 53 and the web 24 with toner so that the extraction roll will be operating properly. At time $T_5$ when the film portion has been properly exposed, an elapsed time of 1–10 seconds, the drive motor 88, the pressure valve in the platen 32, the toner bias on the platen 44 and the extractor drive are actuated. The film portion then moves through the toner station 18 and is sensed by the sensor $A_3$ at time $T_6$ indicating that the film portion has passed through the toning station. This will deactuate the toner pump and toner bias and the film portion will be transported onto the transfer station 20 during the time period from $T_6$ to time $T_7$.

At time $T_7$ when the strip 26 is sensed by the sensor $A_4$ the drive motor 88 will increase its speed for the transfer operation as it has been found that the toning operation is more successful at a lower speed than the transfer operation. The web 24 may move through the toning station at approximately 5 inches/second and may be transferred at a speed of approximately 8 inches/second. As the front edge of the film portion moves into the transfer station 20 the strip 27 is sensed by the sensor $A_5$ at time $T_8$ which actuates the bias on the transfer roller 68 at the same time it is actuated to move against the medium 62 and press it into close proximity with the belt 24 to pass the medium 62 intimately against the film portion of the web 24 as it passes between the two rollers 66 and 68. The first time that the strip 26 is sensed by the sensor $A_6$ at time $T_9$ it energizes the components of the cleaning station 22 and the web 24 then rotates through each of the stations to clean off any residual material from the belt. When the sensor $A_6$ senses the strip 26 a second time at time $T_{10}$ all the systems and stations are deactivated and the web 24 is stopped ready for the next imaging and transfer operation.

Figure 4:
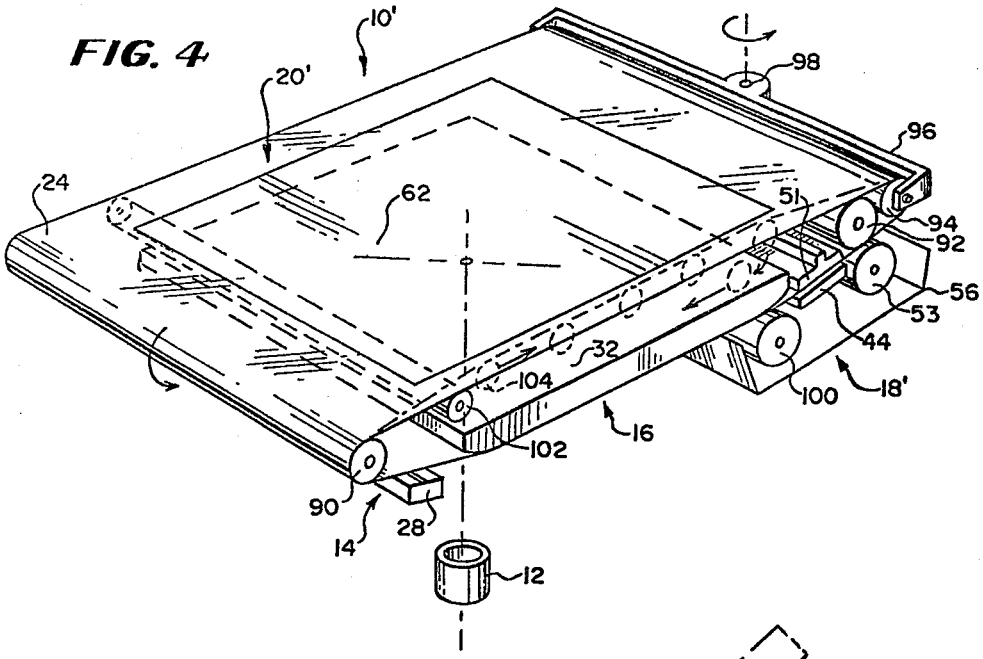
FIG. 4 is a perspective diagram of a second embodiment of the attachment.
Figure 5:
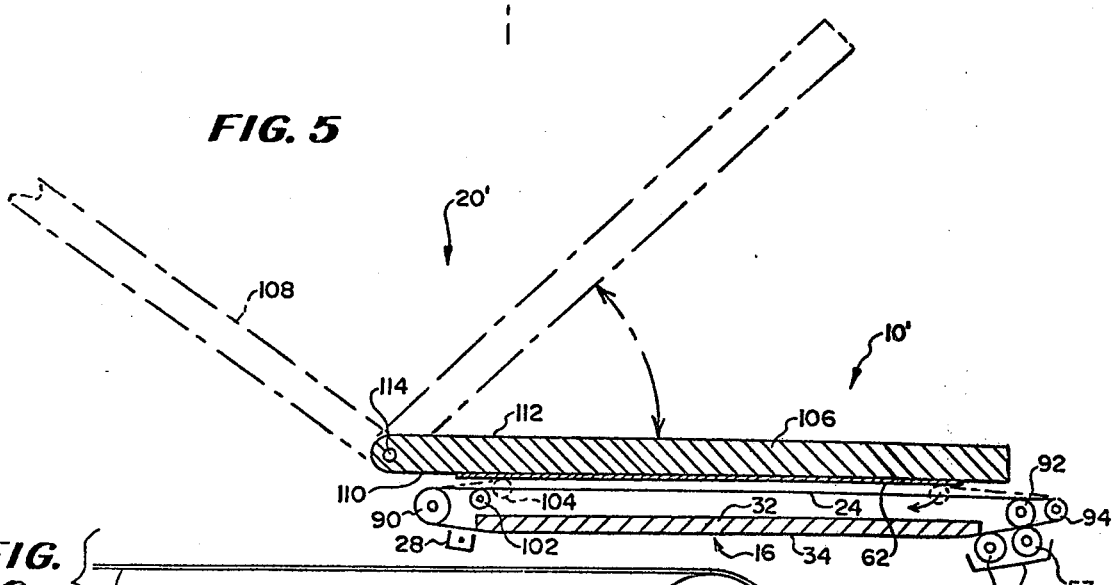
FIG. 5 is a diagram of the embodiment of FIG. 4 showing a second type of transfer mechanism.

Referring now to FIGS. 4 and 5, a second embodiment of the attachment 10' is illustrated. In this embodiment, the charging station 14 and the exposure station 16 remain the same as described previously; however, the cleaning station 22 has been eliminated and a different toning station 18' transfer station 20' are utilized. The basic operation, with the exception of the cleaning operation, remains the same as described previously. The various rollers of FIGS. 1 and 2 have been replaced by two main support rollers 90 and 92, one or both of which are engaged with the motor to frictionally rotate the belt 24 as before. A third adjustable steering roller 94 is inserted in one end of the belt 24 to assure proper alignment of the belt in a like manner as the adjustable roller 36. The roller 94 is connected to a swivel bar 96 which is secured to adjustably pivot around a center point 98 to properly adjust the tracking of the web 24. The center point 98 could of course be replaced by two or more adjustable points on the outer ends of the swivel bar 96 as described before.

The film portion on the web 24 is again charged and exposed as before; however, the toner is applied by a rotating toner feed roll 100 which adhesively picks up the toner from the toner tray or reservoir 56 and applies the toner in a smooth, uniform manner across the width of the film portion of the web 24. As previously mentioned, the toning platen 44 and the upper shoe 51 may be provided to maintain the optimum gap between the web 24 and the toning platen 44. The toner stations 18 and 18' are, of course, interchangeable as desired.

Once the film portion has been toned it continues around the roller 94 to the transfer station 20'. In this embodiment the film portion would be rotated until the front edge of the portion is located toward the end of the transfer station 20'. The web 24 is then stopped and the sheet 62 is then brought into close proximity with the web 24 for the transfer operation. The film portion of the web 24 is brought into close proximity with sheet 62 by a reciprocating transfer roller 102 which is disposed parallel to and below the web 24.

Referring to the timing diagram of FIG. 3, the sensors $A_4$ and $A_5$ would be replaced by a single sensor and the times $T_7$ and $T_8$ would coincide and the drive motor 88 would stop, stopping the rotation of the web and the transfer bias would be applied to sheet 62, not to the roller 102. The roller 102 would be activated and move the roller into the position 104 illustrated in phantom to reciprocate the roller 102 across the film portion, sequentially bringing the film portion of the web 24 into close proximity or contact with sheet 62 across the entire length thereof. The roller 102 would then be returned to its initial position away from the web 24.

One convenient method of locating sheet 62 parallel to the upper reach of the web 24 is a vacuum platen 106. The vacuum platen 106 has a first open or load position 108 which exposes a bottom planar surface 110 having the vacuum or other negative fluid passageways (not shown) opening thereto. Sheet 62 is placed onto the platen 106 in the load position 108 and then the vacuum source (not shown) is operated to clamp sheet 62 to the platen 106 which is then pivoted or otherwise moved to the transfer or receiving position 112. The platen 106 may contain other means to affix sheet 62 to the surface 110 and may be conveniently moved between the open position 108 and the receiving position 112 by pivoting it around a pivot 114. The transfer bias would be applied to the platen 106 and when the transfer roller 102 has returned to its start position at time $T_9$ the platen 106 would move from its receiving position 112 to its load and unload position 108 and the cycle would be stopped ready for the new sheet 62 to be loaded in the next image and transfer operation to take place.

Figure 6:
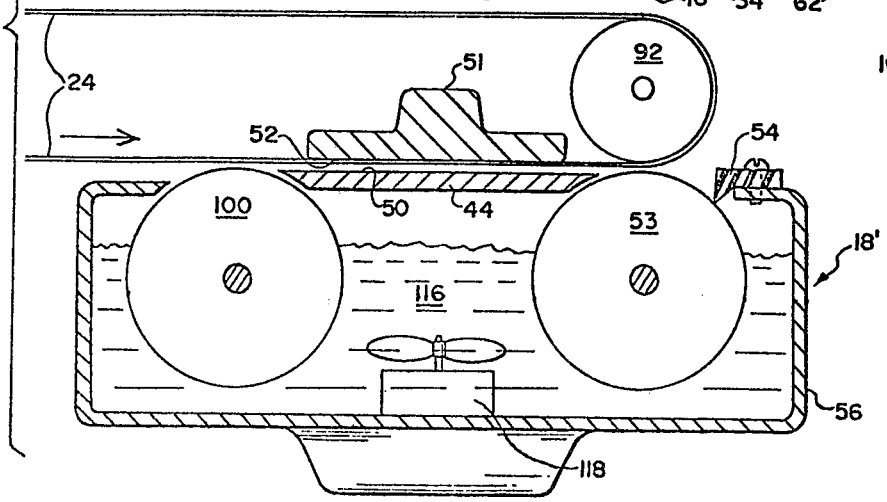
FIG. 6 is an enlarged diagram of the toner station of FIG. 4.

The toning station 18' is best illustrated in FIG. 6. The toner feed roll 100 rotates with its bottom surface submerged in the toner fluid 116 which is kept agitated by a submerged toner agitator 118 to keep the toner particles from settling to the bottom of the tray or reservoir 56. The top of the toner feedroll is positioned approximately 5 to 10 microns from the bottom surface of the web 24. The toner particles adhere to the periphery of the roll 100 as it rotates through the fluid 116 and are attracted in the upper position to the film portion of the web 24. The excess toner fluid will be removed from the web 24 when it exits from the toning platen 44 by the extractor roll 53 which is kept clean by the squeegee 54. The gap between the surfaces 50 and 52 is also more clearly illustrated and is preferably on the order of 5–40 mils with the extraction roll gap being approximately 4 to 6 mils.

Figure 7:
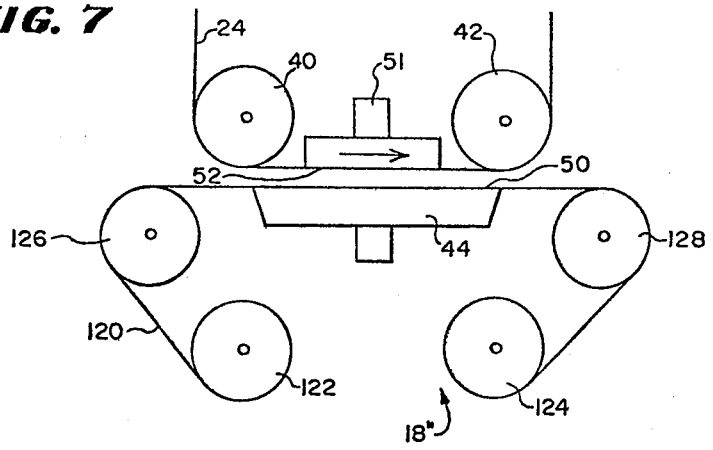
FIG. 7 is a diagram of another embodiment of the toner station to be used with the attachment.

FIG. 7 illustrates a third embodiment of the toning station 18''. In this embodiment a flexible sheet 120 is connected to a pair of drive rolls 122 and 124. The rolls 122 and 124 are driven in tandem to rotate sheet 120 from the roll 122 around a pair of guide rollers 126 and 128 onto the second drive roll 124 to apply toner to the film portion as it passes through the toning station 18''. The toning platen 44, upper shoe 51 and the directional rolls 40 and 42 have been shown merely as illustrations and the flexible sheet 120 or window shade type toning station may also be used with the embodiment as shown in FIG. 4 with or without the toning platen 44 and the upper shoe 51, depending on the tensioning and positioning of the web 24. Once the film has passed through the toning station 18'' the drive rolls 122 and 124 reverse and rewind the flexible sheet or window shade 120 onto the roll 122. The toner may be picked up by the sheet as it unwinds from the roll 122 or may be applied by a manifold like the manifold 46 of FIGS. 1 and 2 after it has passed over the roll 126.

The design of the toning manifolds 46 and 48 and the air knife or air bursh 80 is most clearly illustrated in FIG. 8, where the manifold 46 is shown in section. The fluid air or toner is applied by a pump to one or a number of ports 130 connected to a plurality of passageways 132 which direct the fluid into a first chamber 134. The chamber 134 as well as each of the succeeding chambers and baffles extends the width of the manifold which is of a width substantially equal to the imaged film portion of the web 24. When the fluid has filled the first chamber 134 it will flow through a narrow passageway 136 into the second chamber 138 in a serpentine fashion and from the chamber 138 through a passageway 140 into a third chamber 142 and in a like manner from the third chamber 142 through a confining passage 144 to an exit or nozzle slit 146 in a smooth nonturbulent even flow across the width of the nozzle 146 assuring a substantially constant even flow of toner across the width of the web 24. The manifold 46 may be formed from a single block or may be formed from an upper block portion 148 mated with a lower block portion 150 to form the passageways and chambers therebetween.

The toner preferably will not be applied across the entire width of the web 24 so that the back of the web will remain dry for the motor 88 to frictionally drive the web through one or more of the rolls. Preferably the roll 74 will be driven as the web 24 makes a 180° wraparound this roll. Each of the rolls is preferably made of metal to secure the proper dimension and to make ohmic contact through the rolls 36 and 38.

Figure 9:
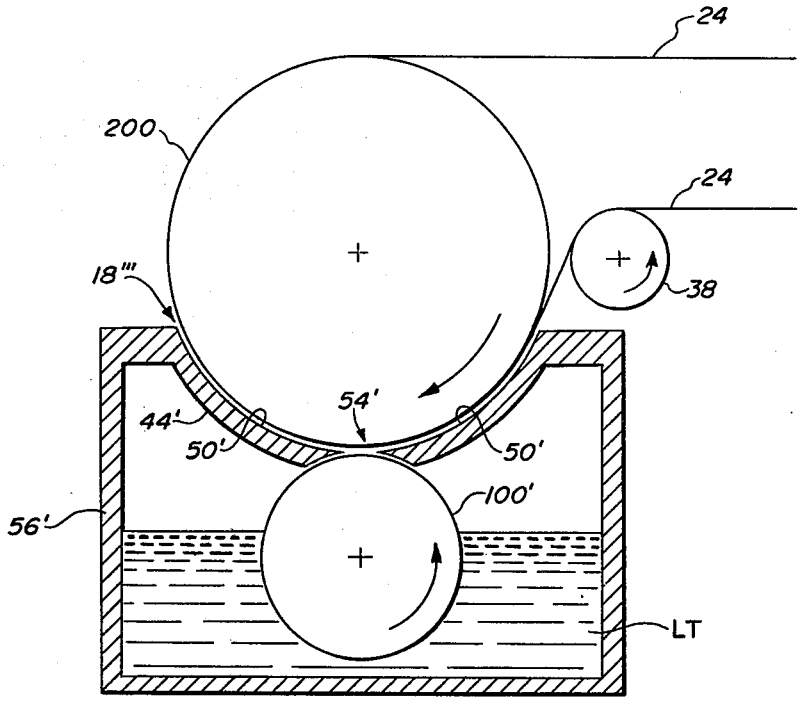
FIG. 9 is a diagram of still another embodiment of the toner station to be used with the attachment.

Referring now to FIG. 9, there is illustrated a fourth embodiment of toning station 18'''. In this embodiment, rollers 40, 42 and 60 of the FIG. 1 embodiment have been replaced by a single roller 200 which is coupled to the drive motor to functionally drive belt 24. A reservoir 56' containing a supply liquid toner LT is located below roller 200. Reservoir 56' includes an arcuate planar top surface 50' which is metallized, has a transverse slot at the center and functions as a toning platen 44'. The gap between top surface 50' and belt 24 is on the order of 5 to 40 mils. A toner feed roller 100' is positioned so as to extend out slightly from the central slot in surface 50' and is mechanically coupled, by means not shown, to drive roller 24. The space between feed roller 100' and the bottom surface of web 24 is on the order of about 5 mils. In operation toner LH is carried up from inside reservoir 56' by feed roller 100' to the space between toning platen top surface 50' and belt 24 and is attracted to the latent image on belt 24. A suitable bias may be applied between surface 50' and belt 24 to assist in the attraction of toner LT to the belt 24. Excess toner LT is recaptured through suitable located openings in reservoir 56'.

Many modifications and variations of the present invention are possible in the light of the above teachings. It is therefore to be understood that within the scope of the appended claims the invention may be practiced otherwise than as specifically described.

What is claimed and desired to be secured by Letters Patent of the United States is:

1. An attachment for an optical projecting system for use in making a copy of a document on a sheet of carrier material comprising:

rotatable endless web means mounted on rollers and having a first planar reach and including at least a portion which is electrophotographic in character, said web and said portion including a front or exposure side and a back side;

drive means for rotating said web sequentially and successively through a set of stations in a single revolution therethrough for each complete cycle;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document thereon;

a toning station downstream of said exposure station for toning the latent image as it is moved through said toning station, including a toner supply reservoir, toning platen means including a uniform conductive toning surface spaced closely proximate the path of said electrophotographic portion facing same and defining a toning gap therebetween, said electrophotographic portion being movable therethrough and feed means associated with said reservoir for transporting toner therefrom to said toning gap for application thereof in a smooth and nonturbulent flow to the latent image carried by said electrophotographic portion and at a location closely proximate said first reach as said portion passes through said toning gap; and a transfer station following said toning station including means for transferring the toned image from said electrophotographic portion onto a sheet of carrier material, including means for moving said sheet of carrier material and said front side of said electrophotographic portion into close proximity during said transfer.

2. An attachment as claimed in claim 1 wherein said toning station includes:

bias means for electrically biasing said electrophotographic portion relative to said toning platen means across said gap to assist in the toning operation.

3. An attachment for use with an optical projection system for use in making a copy of a document electrophotographically comprising:

roller mounted endless web means including at least a portion that is electrophotographic in character, said web and said portion including a front or exposure side and a back side;

drive means for rotating said web through a set of stations sequentially and successively in a single revolution therethrough for each charging, exposure, toning and transfer;

said set of stations including;

a charging station for charging said portion;

an exposure station following said charging station for producing a latent image on said electrophotographic portion;

a toning station following said exposure station including means for applying a substantially constant amount of toner across the width of only said front side of said imaged electrophotographic portion as it is moved through said toner station to produce a toned image on said electrophotographic portion, said toner applying means including toner feed roll means and further including a toning platen having a uniform surface conforming to the path of the electrophotographic portion and facing said electrophotographic portion; and a transfer station following said toning station including means for transferring said toned image from said electrophotographic portion onto a transfer medium, including means for moving said transfer medium and said front side of said toned electrophotographic portion into close proximity during said transfer.

4. An attachment as claimed in claim 1 wherein said toner station includes:

bias means for electrically biasing said imaged electrophotographic portion relative to said toning platen means across the space between them to assist in the toning operation.

5. An attachment as claimed in claim 3 wherein said transfer station includes:

support means disposed against said back side for supporting and positioning said web as it passes through said transfer station;

chute means for feeding carrier material adjacent to but spaced from said web on said front side; and transfer roll means opposite said support roll means being operative by said moving means to press against said carrier material to move it into close proximity with said toned portion for transferring said toned image to said carrier material as it passes through said transfer station between said rolls.

6. An attachment as claimed in claim 5 wherein said transfer station includes:

transfer bias means for electrically biasing said toned portion relative to said carrier material and said transfer roll means to assist in the transfer operation.

7. An attachment for use with an optical projection system for use in making a copy of a document electrophotographically comprising:

roller mounted endless web means including at least a portion that is electrophotographic in character, said web and said portion including a front or exposure side and a back side;

drive means for rotating said web through a set of stations sequentially and successively in a single revolution therethrough for each charging, exposure, toning and transfer;

said set of stations including;

a charging station for charging said portion;

an exposure station following said charging station for producing a latent image on said electrophotographic portion;

a toning station following said exposure station including means for applying a substantially constant amount of toner across the width of only said front side of said imaged electrophotographic portion as it is moved through said toner station to produce a toned image on said electrophotographic portion, said toner applying means including manifold means having at least a first longitudinal baffle connected to a longitudinal exit for flowing said toner onto said imaged electrophotographic portion, said toning station further including a toning platen having a uniform surface conforming to the path of the electrophotographic portion and facing said electrophotographic portion; and a transfer station following said toning station including means for transferring said toned image from said electrophotographic portion onto a transfer medium, including means for moving said transfer medium and said front side of said toned electrophotographic portion into close proximity during said transfer.

8. An attachment for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including;

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it is moved through said toning station, said toning station including, toning platen means including a smooth substantially planar surface spaced from said front side; and P1 manifold means having at least a first longitudinal baffle connected to a longitudinal exit for flowing said toner onto said electrophotographic portion.

9. An attachment as claimed in claim 8, wherein said smooth toning surface of the toning platen means includes an arcuate shaped portion, said portion having a central slot and defining the toning gap between said toning platen means and said electrophotographic portion.

10. An attachment as claimed in claim 9 wherein said toning station includes;

bias means for electrically biasing said electrophotographic portion relative to said toning platen means across said gap to assist in the toning operation.

11. An attachment as claimed in claim 9 wherein said toning surface portion of the toning platen means is made of conductive material.

12. An attachment for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it is moved through said toning station, said toning station includes toning platen means including a smooth uniform toning surface spaced from said front side, defining a gap between the platen means and the front side of said electrophotographic film portion, a supply reservoir containing a liquid toner and a rotatably mounted feed roller for applying liquid toner from the reservoir in a smooth and nonturbulent flow to said gap for application therein to said front side of said electrophotographic portion passing therethrough and a transfer station following said toning station including means for transferring the toned image from said electrophotographic portion onto a sheet of carrier material, including means for moving said sheet of carrier material and said front side of said electrophotographic portion into close proximity during said transfer.

13. An attachment as claimed in claim 12 wherein said smooth toning surface of the toning platen means includes an arcuate shaped portion, said portion having a central slot and defining the toning gap between said toning platen means and said electrophotographic portion.

14. An attachment for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it is moved through said toning station, said toning station including a toner reservoir;

toning platen means, including a smooth substantially uniform surface spaced from said front side defining a toning gap therebetween and toner feed roll means disposed adjacent to said front side for feeding toner to said gap for application thereof to said front side; and a transfer station following said toning station including means for transferring the toned image from said electrophotographic portion onto a sheet of carrier material and said front side of said electrophotographic portion into close proximity during said transfer.

15. An attachment as claimed in claim 14 wherein said toner station includes:

bias means for electrically biasing said electrophotographic portion relative to said toning platen means across the space between them to assist in the toning operation.

16. An attachment for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it is moved through said toning station, said toning station including a container, a quantity of liquid toner in said container, means associated with the container, including a conductive member arranged defining a toning gap between said conductive member and the front side of the electrophotographic portion and feed roller means for transporting liquid toner from said container to the toning gap for application thereof to the latent image carried by the electrophotographic portion; and a transfer station following said toning station including means for transferring the toned image from said electrophotographic portion onto a sheet of carrier material, including means for moving said sheet of carrier material and said front side of said electrophotographic portion into close proximity during said transfer.

17. The attachment according to claim 16 and wherein the feed roller is mechanically coupled to the roller arranged to support and rotate the web.

18. An attachment for an optical projecting system for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it moved through said toning station, said toning station including toning platen means including a smooth arcuate surface disposed proximate a roller for supporting the web, and a transfer station following said toning station including means for transferring the toned image from said electrophotographic portion onto a sheet of carrier material, including means for moving said sheet of carrier material and said front side of said electrophotographic portion into close proximity during said transfer.

19. An attachment for an optical projecting system for use in making a copy of a document on a sheet of carrier material comprising:

rotatable endless web means mounted on rollers and having a first planar reach and including at least a portion which is electrophotographic in character, said web and electrophotographic portion including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging for exposing said electrophotographic portion when said electrophotographic portion is at the first planar reach and forming thereby a latent image of the document;

a toning station following said exposure station for toning the latent image as it is moved through said toning station; and a transfer station following said toning station including means for transferring the toned image from said electrophotographic portion onto a sheet of carrier material, including means for moving said sheet of carrier material and said front side of said electrophotographic portion into close proximity during said transfer and said transfer station including:

support roll means disposed against said back side for supporting and positioning said web and electrophotographic portion as it passes through said transfer station;

chute means for feeding said carrier material adjacent to but spaced from said web on said front side; and transfer roll means opposite said support roll means being operative by said moving means to press against said carrier material to move it into close proximity with said electrophotographic portion for transferring an image to said carrier material as it passes through said transfer station between said rolls.

20. A mechanism as claimed in claim 19 wherein said transfer station includes:

transfer bias means for electrically biasing said electrophotographic portion relative to said carrier material and said transfer roll means to assist in the transfer operation.

21. An attachment for use with an optical projection system for use in making a copy of a document electrophotographically comprising:

roller mounted endless web means including at least a portion that is electrophotographic in character, said web and said portion including a front or exposure side and a back side;

drive means rotating said web through a set of stations sequentially and successively in a single revolution therethrough for each charging, exposure, toning and transfer;

said set of stations including;

a charging station for charging said portion;

an exposure station following said charging station for producing a latent image on said electrophotographic portion;

a toning station following said exposure station including toning platen means having a uniform surface conforming to the path of the electrophotographic portion therepast and facing said electrophotographic portion uniformly spaced therefrom to define a toning gap across the width of only said front side of said imaged electrophotographic portion as it is moved through said toner station, a source of liquid toner, feed roller means associated with said source for applying a substantially constant amount of liquid toner from said source to said gap to produce a toned image on said electrophotographic portion; and a transfer station following said toning station including means for transferring said toned image from said electrophotographic portion onto a transfer medium, including means for moving said transfer medium and said front side of said toned electrophotographic portion into close proximity during said transfer.

22. An attachment as claimed in claim 21 wherein said toning station includes:

a supply of liquid toner and toning means for applying said toner in a smooth and nonturbulent flow to said front side of said imaged electrophotographic portion.

23. An attachment as claimed in claim 21 wherein said toner applying means includes manifold means having at least a first longitudinal baffle connected to a longitudinal exit for flowing said toner onto said imaged electrophotographic portion.

24. A method for reproducing an image onto a sheet of carrier material electrophotographically using an endless web mounted on rollers and having an electrophotographic portion, the web defining first and second generally parallel reaches including;

charging said electrophotographic portion when it enters the first planar reach;

locating and stopping said electrophotographic portion along the first planar reach of the web when said portion is fully disposed therein;

exposing the electrophotographic portion to a light image when the web is stopped within the planar reach;

forming a smooth generally uniform toning gap between a source of liquid toner and the web by spacing a smooth toning surface parallel and closely proximate to the web, applying to said gap liquid toner so that a substantially constant amount of liquid toner is applied across the width of only the bottom side of said electrophotographic portion in a smooth and nonturbulent flow to said portion as the web leaves the first reach; and transferring an image from said electrophotographic portion to a sheet of carrier material in a transfer station, said endless belt being moved successively one revolution for completion of the cycle of charging, exposure, toning and transfer.

25. A method as claimed in claim 24 wherein said toning includes:

electrically biasing said toning surface relative to said electrophotographic portion.

26. A method for reproducing an image onto a sheet of carrier material electrophotographically using an endless web mounted on rollers and having an electrophotographic portion including:

charging said electrophotographic portion;

locating and stopping said electrophotographic portion along a planar reach of the web;

exposing the electrophotographic portion to a light image at the planar reach;

forming a smooth uniform toning gap from said portion of the web as it passes through said toning station, and by placing a smooth toning surface parallel to and spaced closely from said reach portion, applying a substantially constant amount of liquid toner across the width of only the bottom side of said electrophotographic portion in the toning gap; and transferring an image from said electrophotographic portion to a sheet of carrier material in a transfer station.

27. A method as claimed in claim 26 wherein the smooth toning surface includes an arcuate portion and said toner is applied by rolling said toner into close proximity with said electrophotographic portion within the gap.

28. A method as claimed in claim 26 wherein said toning includes:

electrically biasing said toning surface relative to said reach portion.

29. The method as claimed in claim 26 in which said toning gap is formed of arcuate configuration.

30. The method as claimed in claim 26 in which said reach portion at said gap is planar and parallel to the said toning surface.

31. A method for reproducing an image onto a sheet of carrier material electrophotographically using an endless web mounted on rollers and having an electrophotographic portion including:

charging said electrophotographic portion;

locating and stopping said electrophotographic portion along a planar reach of the web;

exposing the electrophotographic portion to a light image at the planar reach;

forming a smooth uniform toning gap from said portion of the web as it passes through said toning station by placing a smooth conductive toning surface parallel to and spaced closely from said portion of the web;

applying a substantially constant amount of liquid toner across the width of only the bottom side of said electrophotographic portion in a toning station;

feeding said carrier material close to but spaced from said web;

moving said sheet of carrier material into close proximity with said electrophotographic portion as it passes through a transfer station; and transferring an image from said electrophotographic portion to said carrier material thereat.

32. A method as claimed in claim 31 wherein said transferring includes:

electrically biasing said carrier material relative to said electrophotographic portion.

33. A method for reproducing an image onto a sheet of carrier material electrophotographically using an endless web mounted on rollers and having an electrophotographic portion including:

charging said electrophotographic portion;

locating and stopping said electrophotographic portion along a planar reach of the web;

exposing the electrophotographic portion to a light image at the planar reach;

forming a uniform toning gap by forming a smooth arcuate portion from a portion of the web as it passes through said toning station adjacent the planar reach and placing a smooth toning surface of conforming configuration parallel to and closely uniformly spaced from said arcuate portion and of conforming configuration thereto and feeding said web to said toning gap directly, applying a substantially constant amount of liquid toner to the toning gap and across the width of only the bottom side of said electrophotographic portion as said portion passes through said toning gap and transferring an image from said electrophotographic portion to a sheet of carrier material in a transfer station.

* * * * *